US012467319B2

(12) United States Patent
Peters et al.

(10) Patent No.: US 12,467,319 B2
(45) Date of Patent: Nov. 11, 2025

(54) DOWNHOLE MOTOR WITH STEERING CAPABILITY

(71) Applicant: Baker Hughes Oilfield Operations LLC, Houston, TX (US)

(72) Inventors: Volker Peters, Niedersachsen (DE); Andreas Peter, Celle (DE); Christian Fulda, Lower Saxony (DE); Tim Mueller, Burgwedel (DE); Ingo Roders, Seelze (DE); Olaf Gaertner, Isernhagen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/511,427

(22) Filed: Nov. 16, 2023

(65) Prior Publication Data

US 2024/0159111 A1 May 16, 2024

Related U.S. Application Data

(60) Provisional application No. 63/425,809, filed on Nov. 16, 2022.

(51) Int. Cl.
*E21B 7/06* (2006.01)

(52) U.S. Cl.
CPC ..... *E21B 7/068* (2013.01)

(58) Field of Classification Search
CPC ..... E21B 7/068; E21B 21/103; E21B 4/02
See application file for complete search history.

(56) References Cited

U.S. PATENT DOCUMENTS

| | | | |
|---|---|---|---|
| 2,167,194 | A | 7/1939 | Alexander |
| 4,512,420 | A | 4/1985 | Hayatdavoudi et al. |
| 4,633,958 | A | 1/1987 | Mouton |
| 4,790,394 | A | 12/1988 | Dickinson, III et al. |
| 4,930,586 | A | 6/1990 | Turin et al. |

(Continued)

OTHER PUBLICATIONS

Notification of Transmittal of the International Search Report and the Written Opinion of the International Searching Authority, or the Declaration; PCT/2023/080065; Mail Date: Mar. 7, 2024; 8 pages.

(Continued)

*Primary Examiner* — Steven A MacDonald
(74) *Attorney, Agent, or Firm* — CANTOR COLBURN LLP

(57) ABSTRACT

A downhole motor, having a body having an outside surface and a longitudinal extent, a first flow passage defined within the body and disposed along the longitudinal extent of the body, and a second flow passage extending from the first flow passage to a channel at the outside surface, wherein a Bernoulli suction force is created at the channel. A method for drilling a borehole, including directing a fluid through a first flow passage defined within a body of a drill and disposed along the longitudinal extent of the body, directing a portion of the fluid from the first flow passage through a second flow passage to a channel at an outside surface to create a Bernoulli suction force at the channel, and drilling a curved section of the borehole by using the Bernoulli suction force at the channel.

21 Claims, 9 Drawing Sheets

(56) References Cited

U.S. PATENT DOCUMENTS

| | | | | |
|---|---|---|---|---|
| 5,074,681 | A * | 12/1991 | Turner | F16C 41/02 175/107 |
| 5,520,256 | A * | 5/1996 | Eddison | E21B 7/068 175/73 |
| 5,542,482 | A * | 8/1996 | Eddison | E21B 7/068 175/76 |
| 5,967,244 | A | 10/1999 | Arfele | |
| 6,581,699 | B1 | 6/2003 | Chen et al. | |
| 8,235,146 | B2 | 8/2012 | Haugvaldstad et al. | |
| 8,302,703 | B2 | 11/2012 | Rolovic | |
| 9,464,482 | B1 | 10/2016 | Bargach et al. | |
| 10,041,302 | B2 | 8/2018 | Blange et al. | |
| 10,100,627 | B2 | 10/2018 | Blange et al. | |
| 10,151,150 | B2 | 12/2018 | Blange et al. | |
| 11,168,523 | B2 | 11/2021 | Mcclure et al. | |
| 11,280,182 | B2 | 3/2022 | Dwars et al. | |
| 2007/0221409 | A1 | 9/2007 | Hall et al. | |
| 2007/0242565 | A1 | 10/2007 | Hall et al. | |
| 2007/0256865 | A1* | 11/2007 | Cruickshank | E21B 7/067 175/73 |
| 2009/0133931 | A1 | 5/2009 | Rolovic | |
| 2010/0116551 | A1 | 5/2010 | Southard et al. | |
| 2011/0139508 | A1 | 6/2011 | Haugvaldstad et al. | |
| 2011/0139512 | A1 | 6/2011 | Haugvaldstad et al. | |
| 2012/0160565 | A1 | 6/2012 | Downton et al. | |
| 2016/0084004 | A1* | 3/2016 | Prill | E21B 21/10 175/24 |
| 2017/0234071 | A1* | 8/2017 | Spatz | E21B 10/26 175/61 |
| 2018/0016844 | A1 | 1/2018 | Peters | |
| 2018/0016845 | A1 | 1/2018 | Peters | |
| 2020/0056451 | A1 | 2/2020 | Chambers et al. | |
| 2020/0199970 | A1 | 6/2020 | Odegbami | |
| 2020/0362637 | A1 | 11/2020 | Peters | |
| 2021/0062585 | A1 | 3/2021 | Nanayakkara et al. | |
| 2023/0366271 | A1 | 11/2023 | Minett-Smith et al. | |
| 2024/0159108 | A1 | 5/2024 | Peters et al. | |
| 2024/0159109 | A1 | 5/2024 | Peters et al. | |

OTHER PUBLICATIONS

Notification of Transmittal of the International Search Report and the Written Opinion of the International Searching Authority, or the Declaration; PCT/US2023/080067; mail date: Mar. 7, 2024: 9 pages.

Notification of Transmittal of the International Search Report and the Written Opinion of the International Searching Authority, or the Declaration; PCT/US2023/080075; Mail date: Feb. 29, 2024; 9 pages.

* cited by examiner

DOWNHOLE MOTOR WITH STEERING CAPABILITY

CROSS REFERENCE TO RELATED APPLICATIONS

This application claims the benefit of an earlier filing date from U.S. Provisional Application Ser. No. 63/425,809 filed Nov. 16, 2022, the entire disclosure of which is incorporated herein by reference.

BACKGROUND

Downhole motors are well known for driving drill bits in the downhole environment. These are commonly used to rotate a drill bit via a rotor while the stator of the motor is essentially geostationary. Where a drill path requires deviation, steering devices are used with these motors. Such devices include bent subs that bias a tool connected to the motor toward a desired direction and/or extending members that push against a borehole wall in a direction opposite a direction of desired progress of the drill bit. While the known methods work acceptably, the art is always receptive to alternatives and improvements.

SUMMARY

An embodiment of a downhole motor including a stator, a rotor configured to rotate relative to the stator, a body connected to the stator having an outside surface and a longitudinal extent, a drive connected to the rotor and disposed in the body and configured for connection with a downhole device to be driven, a first flow passage defined within the body and disposed along the longitudinal extent of the body, and a second flow passage extending from the first flow passage to a channel at the outside surface, wherein a Bernoulli suction force is created at the channel.

An embodiment of a method for drilling a borehole into a subsurface formation, the method including conveying a downhole motor into the borehole, the downhole motor comprising a stator, a rotor configured to rotate relative to the stator, a body connected to the stator having an outside surface and a longitudinal extent, directing a fluid through a first flow passage defined within the body and disposed along the longitudinal extent of the body to rotate the rotor relative to the stator to drive a downhole device connected to the rotor, directing a portion of the fluid from the first flow passage through a second flow passage to a channel at the outside surface to create a Bernoulli suction force at the channel, and drilling a curved section of the borehole by using the Bernoulli suction force at the channel.

An embodiment of a borehole system including a borehole in a subsurface formation, and a downhole motor disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
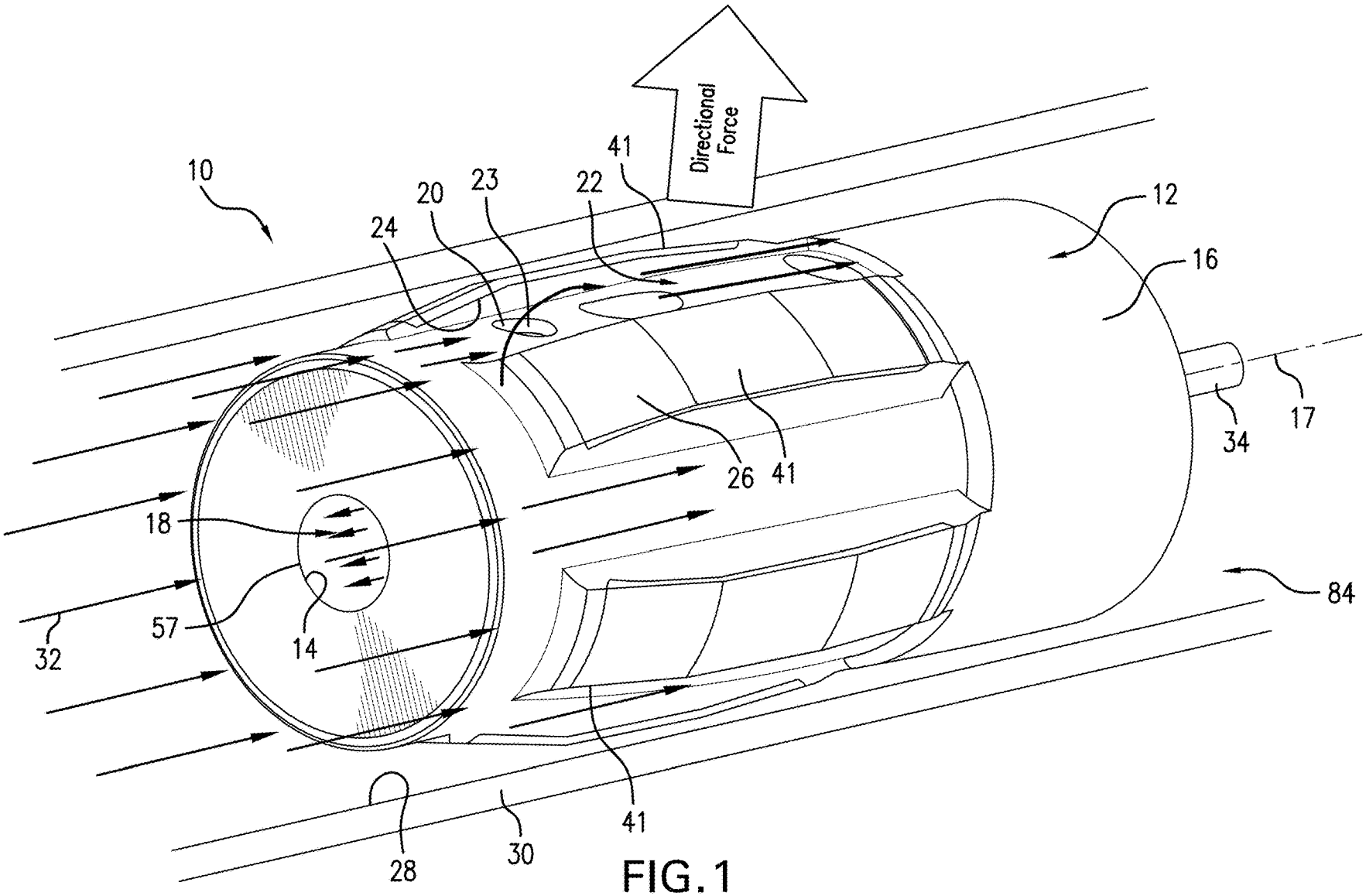
FIG. 1 is a perspective view of a downhole motor with steering capability.
Figure 2:
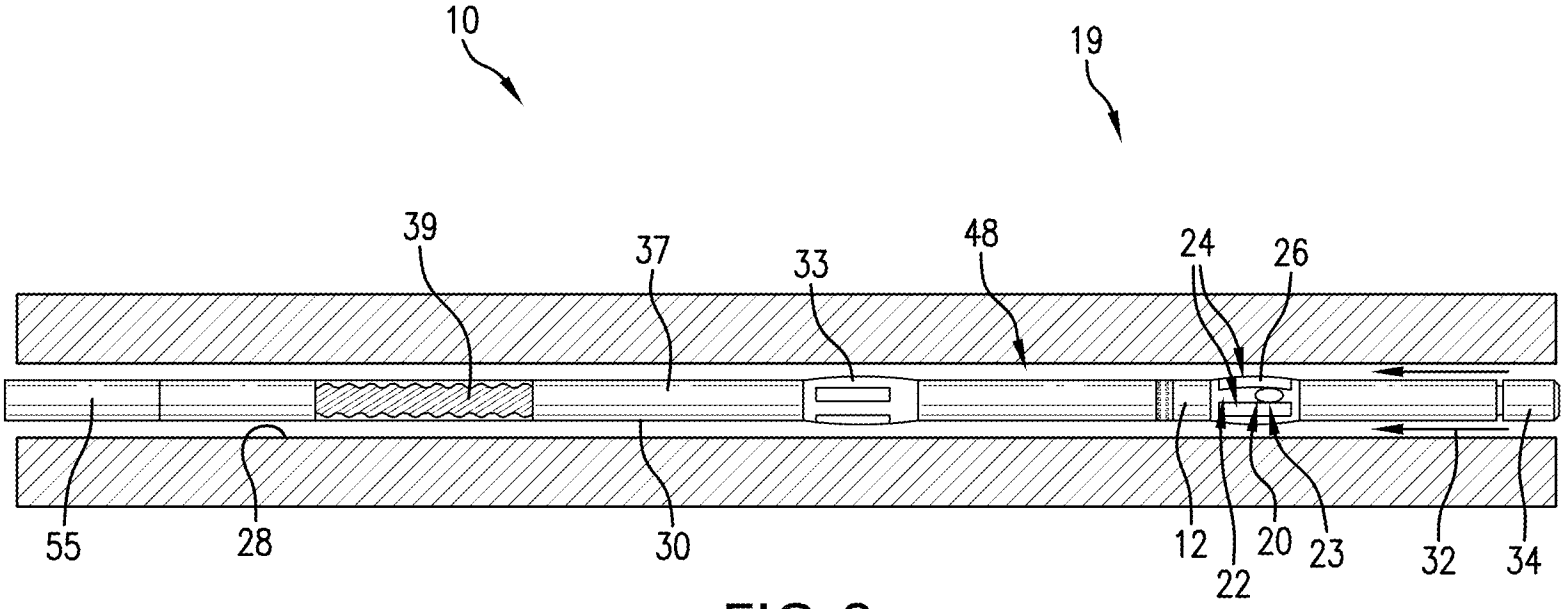
FIGS. 2 and 3 are views that illustrate the drive of the downhole motor with steering capability.

A detailed description of one or more embodiments of the disclosed apparatus and method are presented herein by way of exemplification and not limitation with reference to the Figures.

Referring to FIGS. 1, 2, 3 and 3A, a motor 10, such as a downhole motor or mud motor, with steering capability is illustrated. The motor 10 includes a body 12 having an inside surface 14 and an outside surface 16 and a longitudinal extent.

The body 12 further houses a drive 19 (see FIGS. 2 and 3) that includes a drive shaft 34 and a transmission shaft 48. The drive shaft 34 is configured for connection with a rotor 39 of the motor 10 on the upper side and with a downhole device or tool to be driven on the lower side such as a drill bit 35.

A first flow passage 18 is defined within the body 12 by the inside surface 14 and is disposed along the longitudinal extent of the body 12. The first flow passage 18 is configured to allow a fluid 57 to flow through it from a surface location 74 (FIG. 6) to drill bit 35. A second flow passage 20 is defined in the body 12 extending from the first flow passage 18 to the outside surface 16 of the body 12. One or more channel(s) 22 is formed at the outside surface 16 of the body 12 and is in fluid communication with the second flow passage 20 via flow exit 23 where second flow passage 20 ends and fluid 57 enters the annulus between inside surface 28 of the borehole 30 and the motor 10. The channel 22 may be part of a stabilizer 84 as known in the art and may be formed as a recess in the body 12 or by a buildup of material (e.g., a sleeve, a clamp-on stabilizer) on the outside surface 16 of body 12 or both. If material is built on outside surface 16, it may be adhered to body 12 by welding, brazing, adhesive, fasteners, etc., and may be aligned with or at an angle with other channels distributed along string 56 (FIG. 6) in embodiments. Channels 22 provide for a flow path in which the flow velocity is higher because of the additional flow through the second flow passage 20. The higher flow velocity in the channel that comprises the second flow passage 20 leads to reduced pressure relative to the pressure within the channels without the second flow passage 20. The reduced pressure in the channel with the second flow passage 20 leads to a force (referred to as Bernoulli suction force) perpendicular to the longitudinal axis of the motor 10 that will cause the motor 10 to bend leading to a steering force that can be used to steer the drill bit 35 and motor 10 in a desired direction. In some embodiments, one or more stabilizer(s) 33 may be disposed on string 56. The one or more stabilizer(s) may be located between body 12 and drill bit 35 or above body 12. Bernoulli suction force and steering force may point into the same direction or may point into opposite directions, in embodiments.

In any case, the channel or channels 22 will have a barrier 24 at one or more sides of a channel 22. For example, if channel 22 is part of a stabilizer (such as stabilizer 84), the blades 41 of the stabilizer may also function as barriers 24 at one or either side of channel 22. In some cases the barriers 24 will include expansion elements 26 that extend radially from the barriers 24 to reduce a distance between the barrier 24 and an inside surface 28 of a borehole 30 while the motor 10 is in use. Reducing the distance between the barrier 24 and an inside surface 28 of a borehole 30 reduces flow leakage from channel 22 and hence improves the development of higher velocity fluid flow in the channel 22 intended to have such higher fluid velocity flow which naturally also causes a greater pressure reduction in that channel 22 and accordingly a greater steering input (e.g., a greater steering force) on the motor 10 in that azimuthal direction of channel 22 relative to a longitudinal axis 17 of the motor 10. Expansion elements 26 may include wipers of flexible or soft material, elements comprising swellable or shape memory materials, spring loaded elements, etc. A flexible or soft material may include materials with a relatively low stiffness (e.g., lower than the stiffness of steel) that may be elastic in embodiments. For example, expansion elements 26 may include a foam material or rubber material that has a stiffness lower than that of steel and is elastic by nature. While the barriers 24 discussed above are structural in nature, it is also contemplated to create barriers using additional fluid flow, introduced in addition to fluid flow through channels 22 which may be directed and configured to reduce or prevent fluid exchange between two or more channels 22, thereby acting in a barrier capacity to cause fluid 57 flowing in channel 22 to tend to stay flowing in channel 22.

Still with reference to FIGS. 1, 2, 3, and 3A, while one channel 22 is illustrated in FIG. 1 that includes a flow exit 23 where second flow passage 20 ends and fluid 57 enters the annulus between inside surface 28 of the borehole 30 and the motor 10, it may be that more than one channel 22 may be equipped with corresponding second flow passages 20 and flow exits 23 to fluidically connect first flow passage 18 with the more than one channel 22 and configured for a particular motor 10. More channels 22 producing Bernoulli suction force will increase the steering force generated but also spread that Bernoulli suction force around more of the motor 10. Directional granularity is enhanced with a smaller azimuthal area implicated but generally this comes with reduced Bernoulli effect. A balance can be had and may be enhanced in some cases with channels 22 being narrower such that more than one channel 22 will still create a lower pressure fluid flow in a tighter azimuthal direction. For example, in embodiments the width of channel 22 is less than 60°, such as less than 45° or even less than 30°. Further, in embodiments, channels 22 with a flow exit 23 of corresponding second flow passages 20 may be narrower than other channels 22 included in body 12 that do not include a flow exit 23 in connection with a second flow passages 20 and first flow passage 18.

Whether one or more channels 22 are configured with corresponding second flow passages 20 and flow exit 23 to fluidically connect first flow passage 18 with the more than one channel 22, the result is that the motor 10 will be drawn in the direction of the lower pressure fluid in channels 22 are configured with corresponding second flow passages 20 and flow exit 23 and impart a steering force on the motor 10, drive 19, and/or drill bit 35 attached to the motor 10. It should be understood that FIG. 1 is oriented with the uphole end of the motor 10 at the right side of the drawing so that downhole flow arrows 31 illustrate a direction of downhole fluid flow and return flow arrows 32 illustrate a direction of return fluid flow between the motor 10 and the inside surface 28 and the wall of the borehole 30. Further, it is contemplated that second flow passage 20 may be angled relative to the orthogonal plane of the longitudinal axis 17 of motor 10 so that fluid 57 (for example, drilling fluid, drilling mud, or simply mud) exiting the second flow passage 20 at flow exit 23 does so in a direction toward uphole or with a direction component in the direction that return fluid is flowing (indicated by return flow arrows 32), in use. Fluid 57 from the first flow passage 18 diverted into the second flow passage 20 will cause return fluid flow in the channel 22 where the second flow passage 20 exits to flow with greater velocity than the return fluid naturally flowing between the inside surface 28 of the borehole 30 and the motor 10 at areas of the motor 10 not configured as a return channel 22 that includes a second flow passage 20. The Bernoulli effect generated in the channel 22 causes a steering force and the attached tool (motor 10, drive 19, and/or drill bit 35, for example) to tend toward a direction of second flow passage 20 that allows for steering of the borehole 30. The remaining fluid would exit the string 56 (FIG. 6) through nozzles 83 in the drill bit 35 and to a smaller portion through the bearing section bypass, i.e., through radial bearings 65 and/or axial bearings 73.

Motor 10 may comprise a rotor 39 disposed in a stator 37. Rotor 39 is fixedly connected to drive 19 comprising transmission shaft 48 and drive shaft 34 which in turn is fixedly connected to drill bit 35. Stator 37 is fixedly connected to body 12 including channel 22. When in operation, downhole flowing fluid 57 (indicated by downhole flow arrows 31) will cause rotor 39 to rotate relative to stator 37 thereby rotating drill bit 35 via drive 19. Bearings (e.g., radial bearings 65 and/or axial bearings 73) may support the rotation of rotor 39 relative to stator 37. Stator 37 may be rotated relative to borehole 30 (for example, by a downhole orienting tool 55 or surface equipment, not shown) or may be stationary (not rotating) relative to borehole 30. When stator 37 and body 12 including channel 22 are stationary relative to borehole 30 (i.e., geostationary, which means not rotating with respect to borehole 30), channel 22 including flow exit 23 is at a fixed azimuth about longitudinal axis 17 of motor 10. In this situation, the Bernoulli suction force that is created by the fluid 57 that exits flow exit 23 only occurs at a fixed azimuth interval (e.g., the azimuth interval that is defined by the width of channel 22) while drill bit 35 is still rotated by transmission shaft 48 and drive shaft 34 and drilling progresses. The Bernoulli suction force therefore acts as a steering force that acts on channel 22 and body 12 and is directed toward the azimuth about longitudinal axis 17 of motor 10 at which channel 22 is held stationary. Since the stator 37 may be held geostationary or rotated based upon surface input, and stopped at any time, the azimuthal orientation of the channel 22 relative to the borehole 30 or a reference that is connected to the borehole 30 (e.g., magnetic north or gravitational "up" direction) may be selected to cause steering in that direction. Alternatively, if the stator 37 and therefore body 12 including channel 22 is allowed to rotate, then the steering force that is caused by the fluid 57 that exits flow exit 23 will also rotate about longitudinal axis 17 of motor 10 and thus will cancel out over one or more rotations of body 12 or becomes distributed about 360 degrees of the motor 10 and cancels out thus providing no steering effect to motor 10 and/or drill bit 35.

In embodiments, the second flow passage 20 is closable by a valve 38. Valve 38 is configured to fully open, fully close or choke flow from the first flow passage 18 through the second flow passage 20 to the flow exit 23 thereby allowing, preventing, or regulating the fluid flow to the channel 22 through the second flow passage 20 to thereby control the Bernoulli suction force that is generated by the fluid 57 that exits the second flow passage 20 at flow exit 23 and flow along channel 22. Instructions for the valve 38 may come from a controller 87, e.g., a local controller or a remote controller, including a surface controller. The controller may be an electrical controller, a mechanical controller, etc. and may act based on human input.

Figure 3:
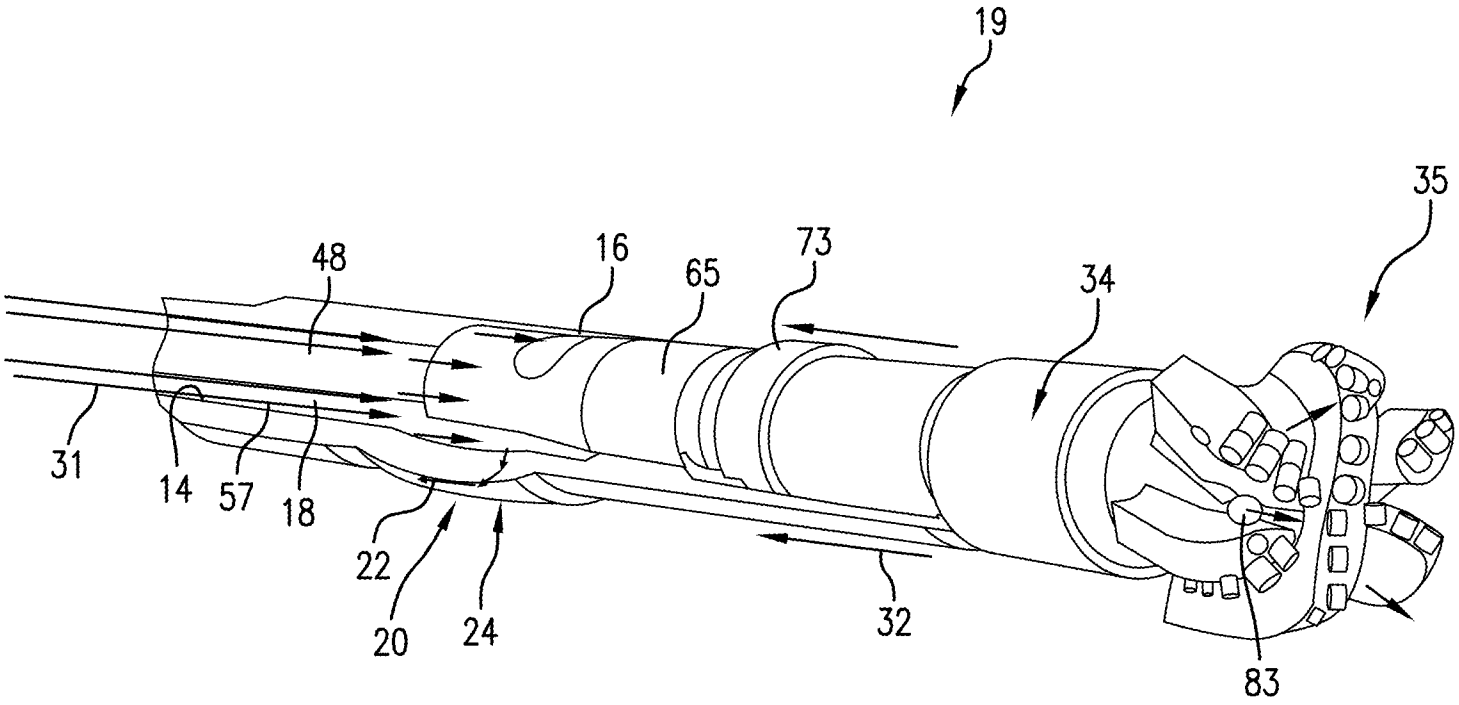
Figure 3A:
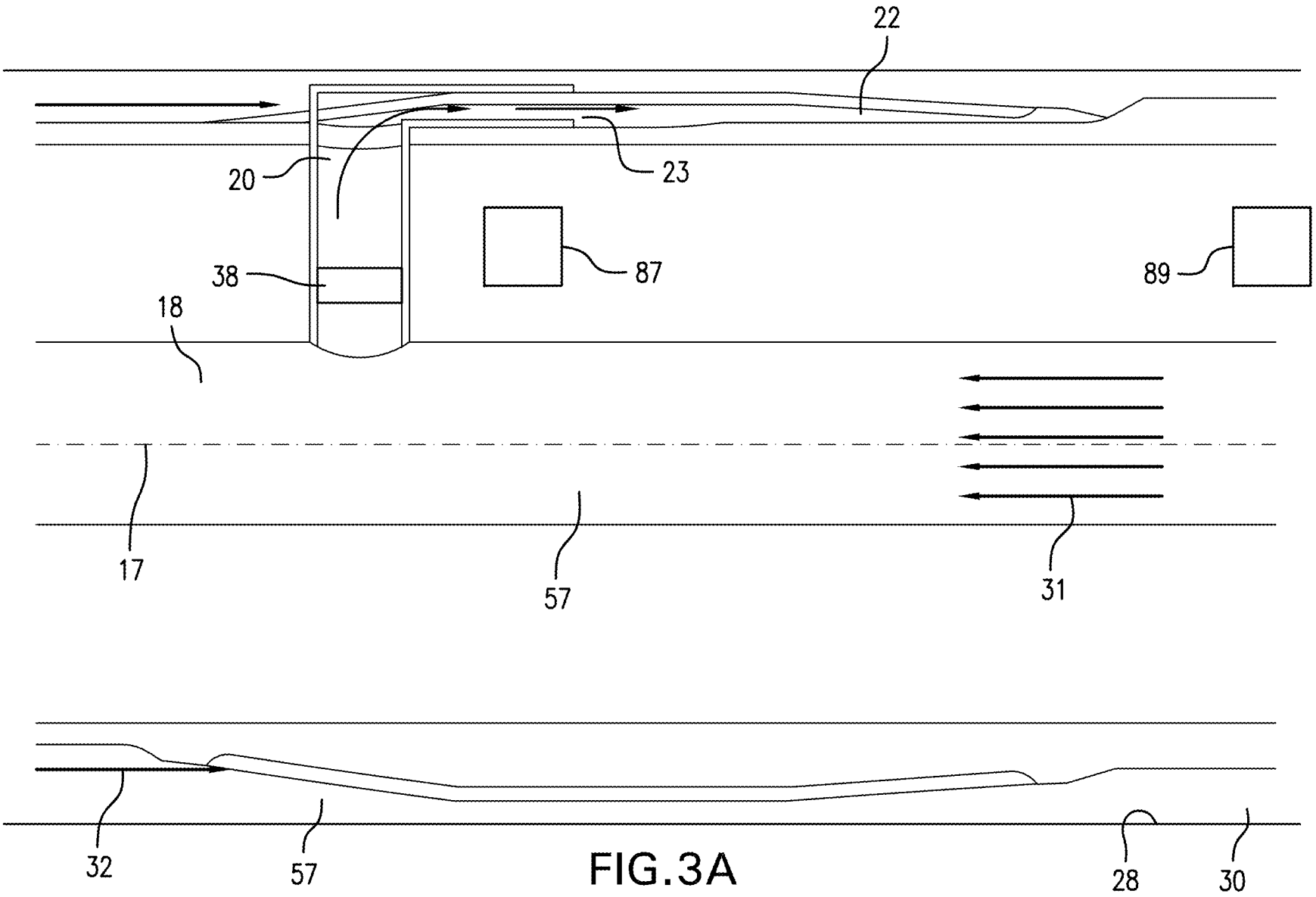
FIG. 3A is a cross sectional view of a downhole motor with steering capability illustrating a directional flow in a downhole motor.
Figure 3B:
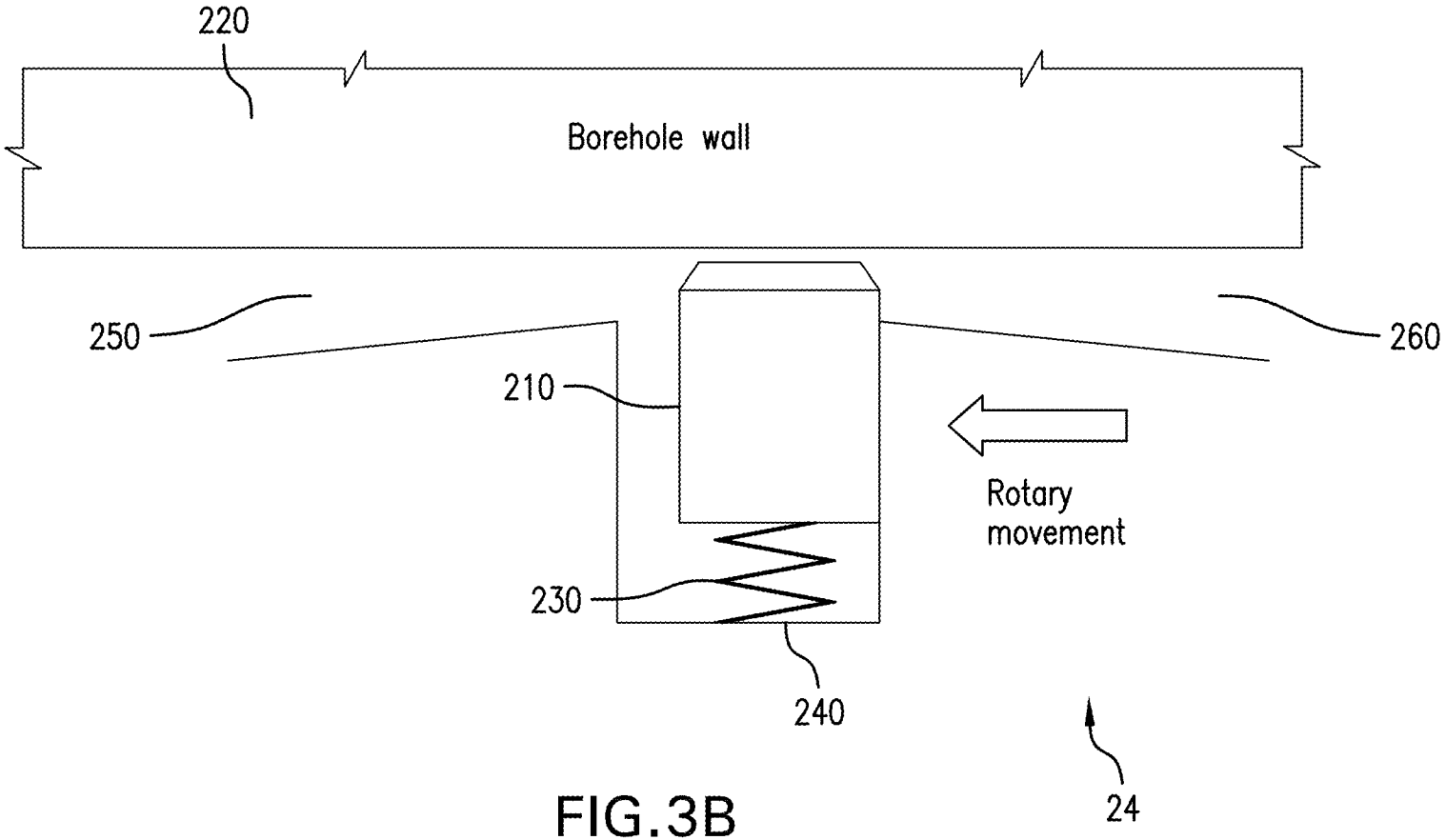
FIG. 3B is an enlarged view illustrating the flow barrier and surrounding components.

Turning now to FIG. 3B, the flow barrier 24 may include an apex seal 210 (cf. FIG. 2), for example, in a groove 240 (such as an elongated groove) along the channel 22 or between channels 22. The flow barrier 24 including the apex seal 210 may be substantially parallel to the longitudinal axis 17 of the motor 10 or may be arranged at an angle with respect to the rotational longitudinal axis 17 of the motor 10. Such apex seal 210 may be energized by biasing members 230, which may include active elements such as actuators and/or which may include passive elements such as (weak) springs in embodiments (for example, springs with a relatively low stiffness that are configured to expand and engage with the inside surface 28 of the borehole 30 at relatively low force to keep the rubbing and friction force at a relatively low level while still inhibiting fluid flow therepast. In some cases, the shape of the radial outside surface of the drill bit 35 may not exactly match the shape of the inside surface 28 of the borehole 30 or borehole wall 220. In these cases, there may be fluid filled spaces or one or more cavities between drill bit 35/motor 10 and borehole wall 220, such as a first cavity 250 and/or a second cavity 260. The flow barrier 24 or apex seal 210 has the effect to limit or reduce the fluid connection between adjacent first and second cavity, thus to limit or reduce the fluid flow between first and second cavity and thereby increasing the sealing effect between the channels 22. Reducing the fluid connection between adjacent first and second cavities further limits the area of relatively high flow to a separated azimuth range that is defined by the first cavity or the second cavity. If the Bernoulli suction force is creating the desired lateral offset towards the borehole wall 220 into direction of the low pressure area, the apex seal 210 can retract against the springs accordingly. Springs are sized to maintain extended position of the apex seal 210.

Figure 4:
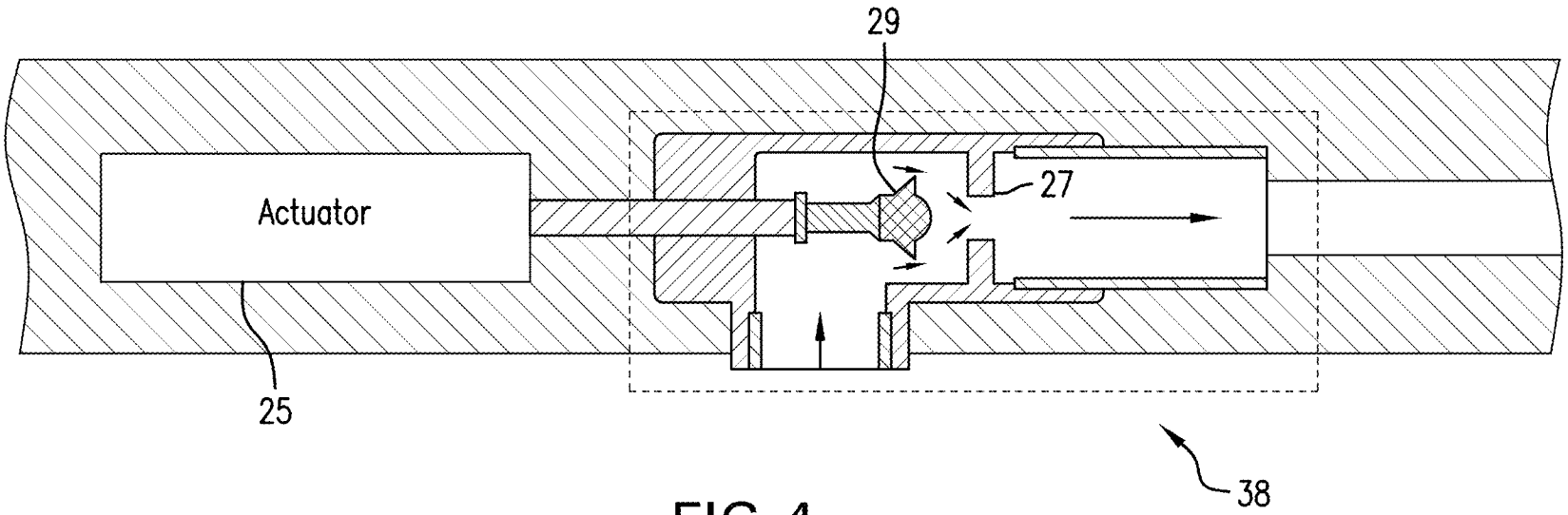
FIG. 4 is a schematic illustration of a poppet type valve.
Figure 5:
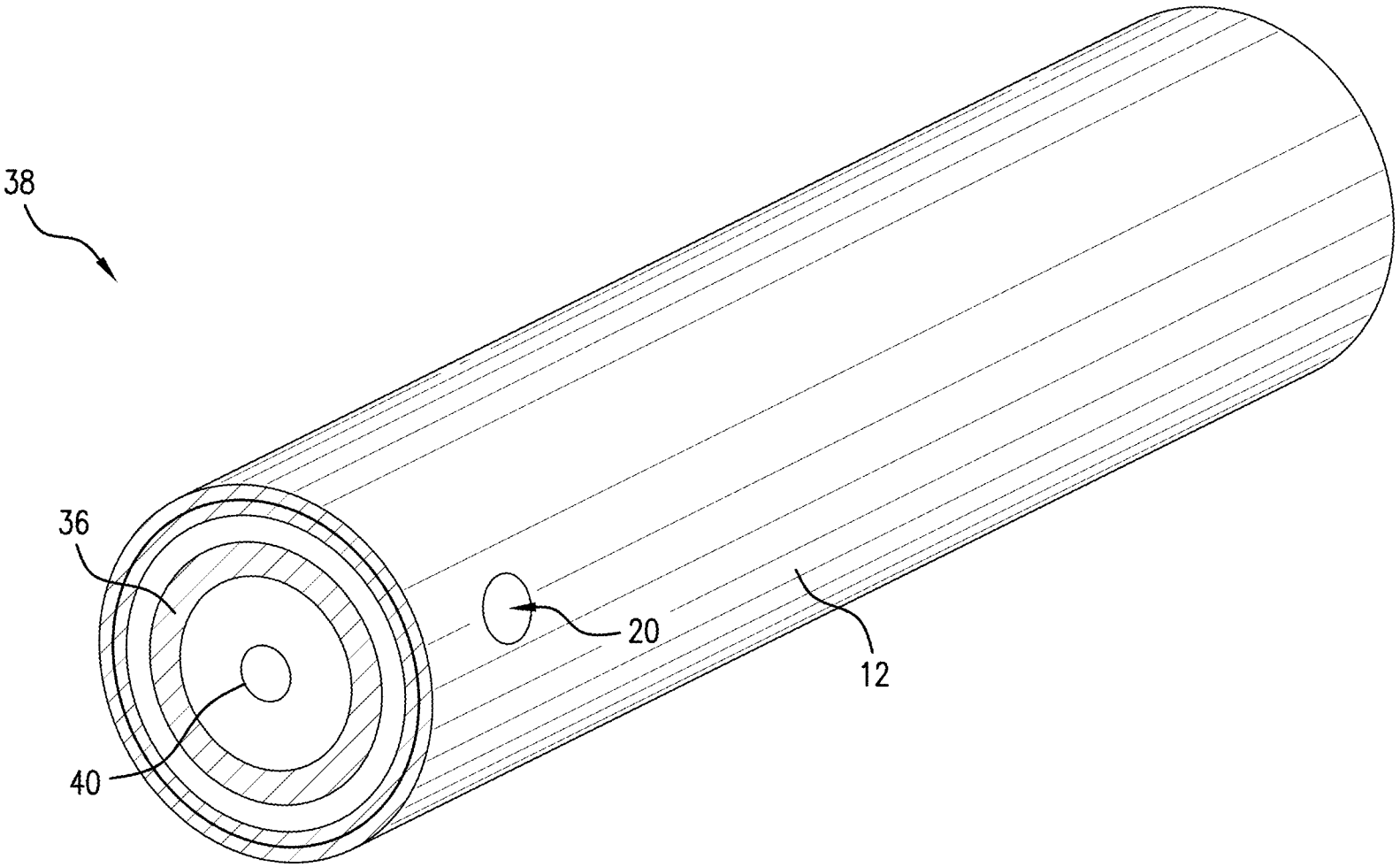
FIG. 5 is a schematic illustration of a sleeve type valve.

The valve 38 may be of a poppet type (see FIG. 4), a rotary type or may be of a sleeve type (see FIG. 5), etc. In FIG. 4, valve 38 is shown as a reciprocating valve (e.g., poppet valve or mushroom valve) where an actuator 25 causes a reciprocating movement of an obstruction member (e.g., plug) 29 to press it onto or release it from an opening (e.g., seat) 27 to regulate flow of fluid 57 through second flow passage 20. Alternatively, actuator 25 may also cause a rotating member (not shown) in operative connection with obstruction member 29 to rotate and to cause the reciprocating movement of obstruction member 29 (for example when the rotating member is a cam shaft that is rotated by actuator 25 and is in operative connection with obstruction member 29 wherein the rotation of the cam shaft causes the reciprocating movement of obstruction member 29). In another example, valve 38 may be a rotary valve in which the rotation of a passage (e.g., a passage included in a transverse plug) connects or disconnects first flow passage 18 with second flow passage 20 to regulate the flow of fluid 57 through the flow exit 23 and corresponding channel 22. For a rotary valve, the obstruction member 29 can be rotated relative to the opening 27. In yet another example, valve 38 may be of a sleeve type. Sleeve 36 is disposed within the body 12 and rotatable therewithin. The sleeve 36 includes a port 40 that is selectively alignable or misalignable with the second flow passage 20 to allow or disallow fluid flow into the second flow passage 20. It is also contemplated that the sleeve port 40 may be positioned such that it overlaps but does not completely align with second flow passage 20, which will allow fluid flow in second flow passage 20 but will choke that flow. The valve 38 may be configured to close the second flow passage 20 during rotation of the body 12 to which the motor 10 is attached and opens the second flow passage 20 when the rotation is stopped or is held stationary. In one embodiment, the valve 38 may be configured to automatically close the second flow passage 20 during rotation of the body 12 to which the motor 10 is attached and automatically opens the second flow passage 20 when the rotation is stopped or is held stationary. For example, directional sensor 89 (e.g., a magnetometer, a gravitometer, or a gyroscope) may send data related to azimuth position of body 12 about longitudinal axis 17 to controller 87 based on which controller 87 may identify if body 12 is rotating or held stationary and, based on this information, may send instructions to either open or close valve 38. The sleeve 36 may be responsive to another action that causes the motor 10 to be held stationary. Springs may be employed to effect this function. Alternatively, the sleeve 36 may be configured to respond to counter rotation of the string to open or close the port 40. Alternatively, springs and or dampers may be employed for opening and closing the sleeve 36. In another alternative embodiment, the sleeve 36 might be configured with elements that contact the inside surface 28 of the borehole 30 those elements being configured to open or to close the sleeve 36.

The motor 10 as disclosed and its employment in the downhole environment results in reduced stress on and wear of motor components, reduced friction of running in the borehole 30 since steering input occurs without borehole wall contact, smoother drilling, reduced formation of ledges in the borehole wall, etc.

Figure 6:
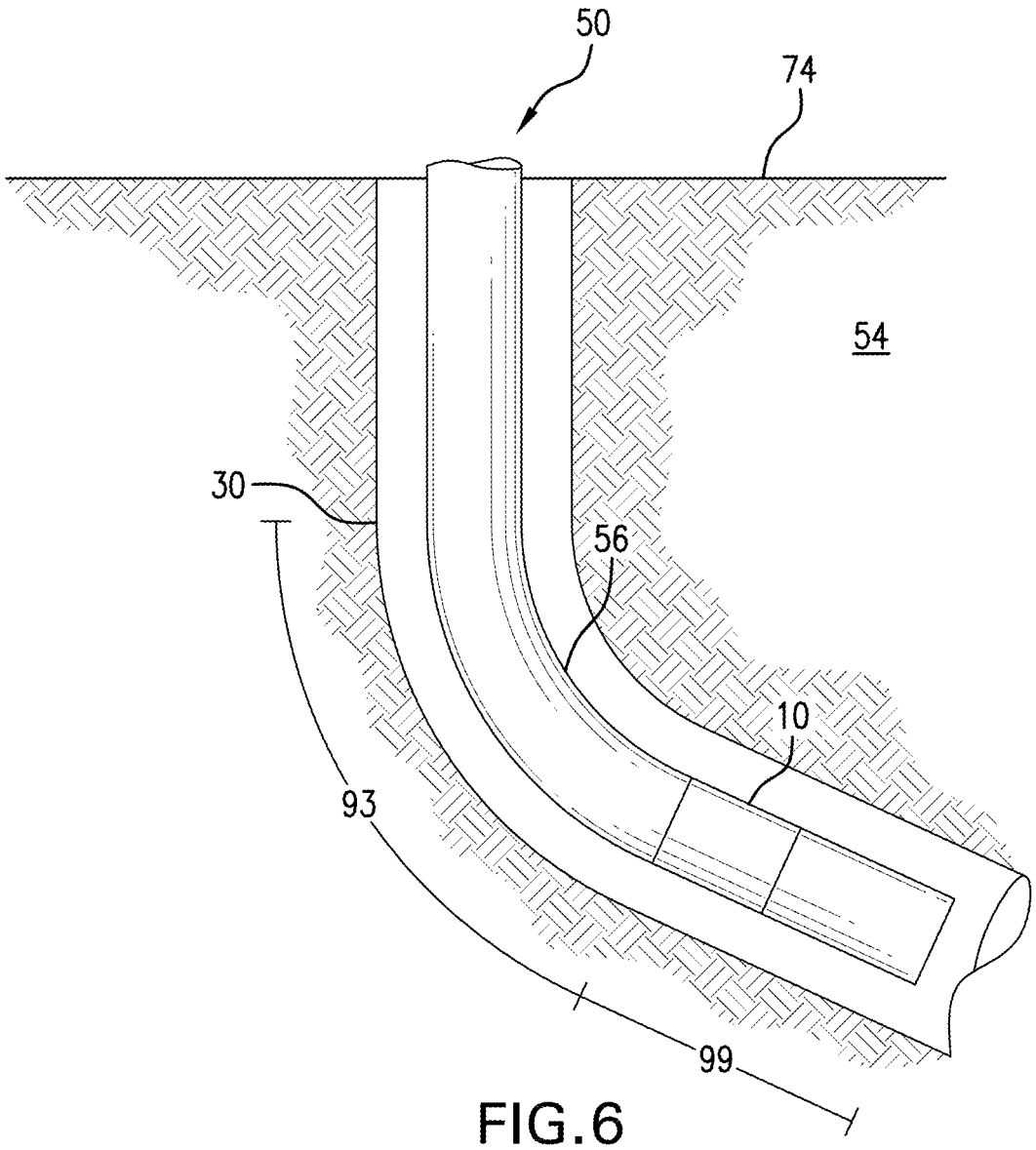
FIG. 6 is a borehole system including the downhole motor with steering capability as disclosed herein.

Referring to FIG. 6, a borehole system 50 includes a borehole 30 in a subsurface formation 54. The borehole comprises a curved section 93 and a tangential or straight section 99. A string 56 is disposed in the borehole 30. The string may be a rotary steering string or a coiled tubing string in embodiments. A downhole motor 10 with steering capability is disposed as a part of the string 56.

Figure 7:
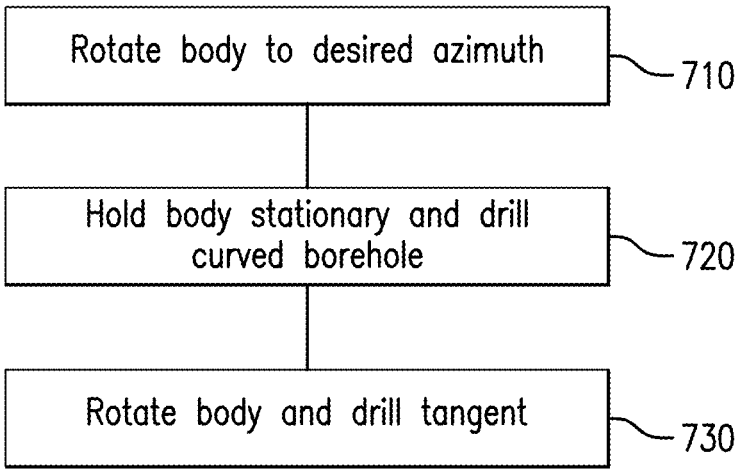
FIG. 7 illustrates a method to drill curved and tangential sections of a borehole with a borehole system as disclosed herein.

Referring now to FIG. 7, a method for drilling a borehole 30 is illustrated, the borehole 30 comprising a curved section 93 and a tangential section 99. To drill the curved section 93, step 710 includes to rotate or orient body 12 of motor 10 so that channel 22 including flow exit 23 points into a desired direction. A directional sensor 89 (e.g., a magnetometer, a gravitometer, or a gyroscope) may measure and send data related to azimuth position of body 12 about longitudinal axis 17. Directional sensor 89 may be located downhole (e.g., within stator 37) or may be located uphole at a surface location 74. The rotate or orient body 12 to the desired azimuth, body 12 may be rotated by equipment on the surface location 74 or may be oriented by downhole equipment, such as a downhole orienting tool 55. When the data sensed by directional sensor 89 indicate that the channel 22 points in the desired direction, in step 720, rotation/orienting of body 12 is stopped and fluid flow is circulated through motor 10 and body 12. Fluid flow will cause rotor 39 of motor 10 to rotate relative to stator 37 which in turn will drive the drill bit 35 via drive 19 to rotate and penetrate into formation 54. A portion of the fluid flow will also flow through second flow passage 20 and flow exit 23 to create a higher flow velocity in channel 22 relative to other azimuthal positions about the circumference of body 12. The higher flow velocity in channel 22 will cause a Bernoulli suction force at channel 22 towards the desired azimuth which causes string 56 to bend and therefore a steering force that causes drill bit 35 to deviate from a linear progression that ultimately leads to a curved section 93 of borehole 30. When, at a particular depth of borehole 30, it is desired to proceed with a tangent, such as a tangential section 99, in step 730, stator 37 of motor 10 and body 12 will be rotated, for example by corresponding equipment (such as a rotary table) at the surface location 74, while flow of fluid 57 is still maintained. By rotating body 12, the Bernoulli suction force that is created by the additional flow through second flow passage 20 and flow exit 23 will also rotate about longitudinal axis 17 of motor 10 and thus will cancel out over one or more rotations of body 12 or becomes distributed about 360 degrees of the motor 10 to drill borehole 30 without any deviation and create a tangential section 99 of borehole 30. Alternatively, an actuator 25 may operate a valve 38 in second flow passage 20 to close second flow passage 20 when body 12 is rotated (for example, when data is sent by directional sensor 89 that indicates that body 12 is rotating).

Set forth below are some embodiments of the foregoing disclosure:

Embodiment 1: A downhole motor including a stator, a rotor configured to rotate relative to the stator, a body connected to the stator having an outside surface and a longitudinal extent, a drive connected to the rotor and disposed in the body and configured for connection with a downhole device to be driven, a first flow passage defined within the body and disposed along the longitudinal extent of the body, and a second flow passage extending from the first flow passage to a channel at the outside surface, wherein a Bernoulli suction force is created at the channel.

Embodiment 2: The downhole motor as in any prior embodiment wherein at least a portion of the second flow passage is angled relative to an orthogonal plane of a longitudinal axis of the body and ends at a flow exit in the channel that allows fluid to exit the second flow passage in a direction toward uphole.

Embodiment 3: The downhole motor as in any prior embodiment, wherein the downhole device is a drill bit that is connected to the drive.

Embodiment 4: The downhole motor as in any prior embodiment, wherein the channel is defined by one or more flow barriers.

Embodiment 5: The downhole motor as in any prior embodiment, wherein the flow barriers comprise a soft material.

Embodiment 6: The downhole motor as in any prior embodiment, wherein the flow barriers are spring loaded.

Embodiment 7: The downhole motor as in any prior embodiment, wherein the flow barriers include one or more seal extensions.

Embodiment 8: The downhole motor as in any prior embodiment, further comprising a downhole orienting tool, configured to orient the channel into a direction of a preselected azimuth or azimuth interval.

Embodiment 9: The downhole motor as in any prior embodiment, further including a valve in the body selectively allowing, preventing or chocking flow through the second passage.

Embodiment 10: The downhole motor as in any prior embodiment, further comprising a directional sensor, wherein the valve is operated based on measurements by the directional sensor.

Embodiment 11: A method for drilling a borehole into a subsurface formation, the method including conveying a downhole motor into the borehole, the downhole motor comprising a stator, a rotor configured to rotate relative to the stator, a body connected to the stator having an outside surface and a longitudinal extent, directing a fluid through a first flow passage defined within the body and disposed along the longitudinal extent of the body to rotate the rotor relative to the stator to drive a downhole device connected to the rotor, directing a portion of the fluid from the first flow passage through a second flow passage to a channel at the outside surface to create a Bernoulli suction force at the channel, and drilling a curved section of the borehole by using the Bernoulli suction force at the channel.

Embodiment 12: The method as in any prior embodiment wherein the directing the portion of the fluid from the first flow passage through the second flow passage to the channel further comprises exiting the portion of the fluid from the second flow passage in a direction toward uphole.

Embodiment 13: The method as in any prior embodiment wherein the downhole device is a drill bit that is connected to the drive.

Embodiment 14: The method as in any prior embodiment, wherein the channel is defined by one or more flow barriers.

Embodiment 15: The method as in any prior embodiment, wherein the flow barriers comprise a soft material or one or more seal extensions.

Embodiment 16: The method as in any prior embodiment, wherein the flow barriers are spring loaded.

Embodiment 17: The method as in any prior embodiment, further comprising drilling a straight section of the borehole with the downhole motor.

Embodiment 18: The method as in any prior embodiment, further comprising orienting the channel into a direction of a preselected azimuth or azimuth interval.

Embodiment 19: The method as in any prior embodiment, further comprising actuating a valve to allow, prevent or choke fluid flowing through the second fluid passage.

Embodiment 20: The method as in any prior embodiment, further comprising sensing with a directional sensor information related to an azimuth of the channel and operating the valve based on measurements by the directional sensor.

Embodiment 21: A borehole system including a borehole in a subsurface formation, and a downhole motor as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole motor comprising:

a stator;

a rotor configured to rotate relative to the stator;

a body connected to the stator having an outside surface and a longitudinal extent;

a drive connected to the rotor and disposed in the body, the drive configured to rotate within the body and configured for connection with a downhole device to be driven;

a first flow passage defined between the body and the drive and disposed along the longitudinal extent of the body; and a second flow passage extending from the first flow passage to a channel at the outside surface, wherein a Bernoulli suction force is created at the channel.

2. The downhole motor as claimed in claim 1 wherein at least a portion of the second flow passage is angled relative to an orthogonal plane of a longitudinal axis of the body and ends at a flow exit in the channel that allows fluid to exit the second flow passage in a direction toward uphole.

3. The downhole motor as claimed in claim 1, wherein the downhole device is a drill bit that is connected to the drive.

4. The downhole motor as claimed in claim 1, wherein the channel is defined by one or more flow barriers.

5. The downhole motor as claimed in claim 4, wherein the flow barriers comprise a soft material.

6. The downhole motor as claimed in claim 4, wherein the flow barriers are spring loaded.

7. The downhole motor as claimed in claim 4, wherein the flow barriers include one or more seal extensions.

8. The downhole motor as claimed in claim 1, further comprising a downhole orienting tool, configured to orient the channel into a direction of a preselected azimuth or azimuth interval.

9. The downhole motor as claimed in claim 1, further including a valve in the body selectively allowing, preventing or choking flow through the second flow passage.

10. The downhole motor as claimed in claim 9, further comprising a directional sensor, wherein the valve is operated based on measurements by the directional sensor.

11. A borehole system comprising:

a borehole in a subsurface formation; and the downhole motor as claimed in claim 1 disposed in the borehole.

12. A method for drilling a borehole into a subsurface formation, the method comprising:

conveying a downhole motor into the borehole, the downhole motor comprising:

a stator;

a rotor configured to rotate relative to the stator;

a body connected to the stator having an outside surface and a longitudinal extent;

a drive connected to the rotor and disposed in the body, the drive configured to rotate within the body and configured for connection with a downhole device to be driven;

directing a fluid through a first flow passage defined between the body and the drive and disposed along the longitudinal extent of the body to rotate the rotor relative to the stator to drive the downhole device connected to the rotor;

directing a portion of the fluid from the first flow passage through a second flow passage to a channel at the outside surface to create a Bernoulli suction force at the channel; and drilling a curved section of the borehole by using the Bernoulli suction force at the channel.

13. The method as claimed in claim 12 wherein the directing the portion of the fluid from the first flow passage through the second flow passage to the channel further comprises exiting the portion of the fluid from the second flow passage in a direction toward uphole.

14. The method as claimed in claim 12 wherein the downhole device is a drill bit that is connected to the drive.

15. The method as claimed in claim 12, wherein the channel is defined by one or more flow barriers.

16. The method as claimed in claim 15, wherein the flow barriers comprise a soft material or one or more seal extensions.

17. The method as claimed in claim 15, wherein the flow barriers are spring loaded.

18. The method as claimed in claim 12, further comprising drilling a straight section of the borehole with the downhole motor.

19. The method as claimed in claim 12, further comprising orienting the channel into a direction of a preselected azimuth or azimuth interval.

20. The method as claimed in claim 12, further comprising actuating a valve to allow, prevent or choke the fluid flowing through the second flow passage.

21. The method as claimed in claim 20, further comprising sensing with a directional sensor information related to an azimuth of the channel and operating the valve based on measurements by the directional sensor.

* * * * *